US008286557B2

(12) United States Patent
Endicott et al.

(10) Patent No.: US 8,286,557 B2
(45) Date of Patent: Oct. 16, 2012

(54) PROJECTILES FOR MARKING TARGETS, METHODS OF MANUFACTURING THE SAME, AND METHODS OF UTILIZING THE SAME

(75) Inventors: David W. Endicott, Mendon, UT (US); Daniel W. Doll, Marriott Slaterville, UT (US); R. Brad Cragun, Pleasant View, UT (US); Jared K. Olson, North Ogden, UT (US); Michael T. Rose, Tremonton, UT (US); Mark A. Moore, Ogden, UT (US); James D. Rozanski, Brigham City, UT (US); Russell J. George, Pleasant View, UT (US)

(73) Assignee: Alliant Techsystems Inc., Arlington, VA (US)

( * ) Notice: Subject to any disclaimer, the term of this patent is extended or adjusted under 35 U.S.C. 154(b) by 370 days.

(21) Appl. No.: 12/534,450

(22) Filed: Aug. 3, 2009

(65) Prior Publication Data

US 2011/0023744 A1 Feb. 3, 2011

(51) Int. Cl.
*F42B 12/40* (2006.01)
*F42B 8/00* (2006.01)

(52) U.S. Cl. ..... 102/513; 102/498; 102/529; 102/444; 86/51

(58) Field of Classification Search ..... 102/395, 102/444, 445, 458, 498, 502, 513, 529; 362/34; 86/51, 54

See application file for complete search history.

(56) References Cited

U.S. PATENT DOCUMENTS

| | | | | |
|---|---|---|---|---|
| 375,190 | A | 12/1887 | Palmer | |
| 1,819,106 | A | 8/1931 | McBride et al. | |
| 3,282,714 | A | 11/1966 | Wessells | |
| 3,515,070 | A | 6/1970 | Cutler et al. | |
| 3,736,874 | A | 6/1973 | Gerber | |
| 3,774,022 | A | 11/1973 | Dubrow et al. | |
| 3,940,605 | A | 2/1976 | Gerber | |
| 3,995,550 | A | 12/1976 | D'Amico, Jr. | |
| 4,094,246 | A | 6/1978 | Travor | |
| 4,553,481 | A * | 11/1985 | Ricci | 102/458 |
| 4,706,568 | A | 11/1987 | Lundwall et al. | |
| 5,001,880 | A | 3/1991 | Smith | |
| 5,009,164 | A | 4/1991 | Grinberg | |
| 6,235,148 | B1 * | 5/2001 | Courson et al. | 156/379.6 |
| 6,497,181 | B1 | 12/2002 | Manole et al. | |
| 6,574,945 | B2 | 6/2003 | Martinez, Jr. | |
| 6,615,739 | B2 | 9/2003 | Gibson et al. | |
| 6,619,211 | B1 * | 9/2003 | Haeselich | 102/513 |
| 6,931,993 | B1 | 8/2005 | Manole et al. | |
| 6,990,905 | B1 | 1/2006 | Manole et al. | |
| 7,055,438 | B1 | 6/2006 | Manole et al. | |
| 7,143,699 | B2 | 12/2006 | Brock et al. | |
| RE40,482 | E * | 9/2008 | Haeselich | 102/513 |
| 7,919,019 | B2 * | 4/2011 | Park et al. | 252/700 |
| 2005/0188886 | A1 | 9/2005 | Vasel et al. | |
| 2006/0214141 | A1 | 9/2006 | Yankielun et al. | |

* cited by examiner

*Primary Examiner* — James Bergin
(74) *Attorney, Agent, or Firm* — TraskBritt

(57) ABSTRACT

Projectiles containing a fluorophore composition comprising a fluorophore compound and an activator composition comprising an activator compound for marking targets are disclosed. Some embodiments include a nose structure with a cavity radially segmented into a plurality of radially isolated compartments by at least one laterally and radially extending internal wall. Additional embodiments include a fore compartment and an aft compartment sealed by a septum. Yet additional embodiments include at least one pressurized cavity and may further include a plunger positioned and configured to pierce each pressurized cavity. Methods of manufacturing target marking projectiles and methods of marking targets are also disclosed.

17 Claims, 5 Drawing Sheets

PROJECTILES FOR MARKING TARGETS, METHODS OF MANUFACTURING THE SAME, AND METHODS OF UTILIZING THE SAME

FIELD OF THE INVENTION

The invention relates to target marking projectiles. In particular, embodiments of the invention relate to projectiles for marking a target with a luminescent composition, methods of manufacturing the projectile, and methods of marking the targets.

BACKGROUND

Targets, such as inanimate objects, may be marked using several methods, including lasers, pyrotechnics, chalk and paint.

Lasers may be utilized by directing a laser beam from a warfighter onto a target to mark the target with laser light. However, the laser must continue to emit light onto the target in order for the target to remain marked. The emission of laser light from the laser to the target may reveal the location of the warfighter and the target to hostile fighters.

Pyrotechnics may be used to provide illumination to mark a target. However, pyrotechnic devices contain energetic materials that may exhibit hazard sensitivity. In addition, the use of pyrotechnics may pose a fire hazard and their components and designs may be complex.

Chalk and paint may also be utilized to mark a target. However, chalk may be difficult for a warfighter to see and identify and paint may require manual application, which is impractical and dangerous.

Additionally, each of these methods of application may cause the marked target to be identified by a hostile fighter.

In view of the foregoing, it would be advantageous to provide improved target-marking devices, and methods for marking the target that address shortcomings in the art.

BRIEF SUMMARY

In some embodiments, a projectile may comprise a nose structure having a cavity that is radially segmented into a plurality of radially isolated compartments by at least one laterally and radially extending internal wall. The projectile may also include a fluorophore composition comprising a fluorophore compound contained in at least one radially isolated compartment of the plurality of radially isolated compartments and an activator composition comprising an activator compound contained in at least another radially isolated compartment of the plurality of radially isolated compartments.

In additional embodiments, a projectile may comprise a payload body including a nose structure defining a fore compartment therein and a cup structure defining an aft compartment therein. The projectile may further include a septum sealing both the aft compartment of the cup structure and the fore compartment of the nose structure. Additionally, one of the fore and aft compartments may contain a fluorophore composition and the other of the fore and aft compartments may contain an activator composition.

In further embodiments, a projectile may comprise at least one pressurized cavity having at least one first compartment and at least one second compartment therein, the at least one first compartment containing a fluorophore composition and the at least one second compartment containing an activator composition. The projectile may additionally include a plunger positioned and configured to pierce the at least one pressurized cavity upon impact with a target.

In additional embodiments, a method of manufacturing a projectile may comprise forming a nose structure comprising a plurality of radially isolated compartments within the nose structure and positioning a fluorophore composition comprising a fluorophore compound within at least a first radially isolated compartment of the plurality of radially isolated compartments. The method may additionally include positioning an activator composition comprising an activator compound within at least a second radially isolated compartment of the plurality of radially isolated compartments.

In yet further embodiments, a method of manufacturing a projectile may comprise forming a nose structure having a first cavity, the first cavity containing a fluorophore composition comprising a fluorophore compound or an activator composition comprising an activator compound. The method may additionally include forming a cup structure comprising a second cavity, the second cavity containing the other of the fluorophore composition comprising the fluorophore compound or the activator composition comprising the activator compound, and separating the first cavity and the second cavity with a septum.

In yet additional embodiments, a method of marking a target may comprise launching a projectile including at least one pressurized cavity having at least one first compartment and at least one second compartment therein toward a target, the at least one first compartment containing a fluorophore composition and the at least one second compartment containing an activator composition. The method may further include mixing the fluorophore composition and the activator composition to form a luminescent composition, impacting the target with the projectile, piercing the at least one pressurized cavity, and expelling at least a portion of the luminescent compound from the at least one pressurized cavity onto the target.

In further embodiments, a method of marking a target may comprise launching a projectile comprising a plurality of radially isolated compartments. At least one of the plurality of radially isolated compartments may contain a fluorophore composition and at least one of the plurality of radially isolated compartments may contain an activator composition. The method may further include combining the fluorophore composition and the activator composition to form a luminescent composition and impacting a target with the projectile to disperse the luminescent composition onto the target.

In additional embodiments, a method of marking a target may comprise launching a projectile comprising a plurality of radially isolated compartments, at least one of the plurality of radially isolated compartments containing a fluorophore composition and at least one of the plurality of radially isolated compartments containing an activator composition. The method may further comprise combining the fluorophore composition and the activator composition to form a luminescent composition upon impact of the projectile with a target and dispersing the luminescent composition onto the target.

DETAILED DESCRIPTION

The illustrations presented herein are not meant to be actual views of any particular device or projectile, but are merely idealized representations that are employed to describe various embodiments of the present invention. Elements that are common between figures may retain the same numerical designation.

A projectile for marking a target with a luminescent composition is disclosed. The projectile is sized and configured, by way of non-limiting example, as a 40 mm ordnance round and is launched from a conventional weapon, such as a grenade launcher. The 40 mm ordnance round may include, but is not limited to, a 40 mm grenade, mortar, artillery, or mine. The projectile includes a fluorophore composition and an activator composition separately maintained in sections or compartments of the projectile. The fluorophore composition and the activator composition are fluids and are maintained in an unreacted state until launch or impact of the projectile. The fluorophore composition includes a fluorophore compound and the activator composition includes an activator compound. Upon launch of the projectile or when the projectile impacts the target, the fluorophore composition and the activator composition are combined and react to produce the luminescent composition, which emits light in the visible or near infrared (NIR) spectrum. The luminescent composition is substantially free of energetic materials, reducing its impact on the environment and on human health. The projectile may be effective in marking targets formed from a variety of materials including, but not limited to, wood, concrete, or stone.

Figure 1:
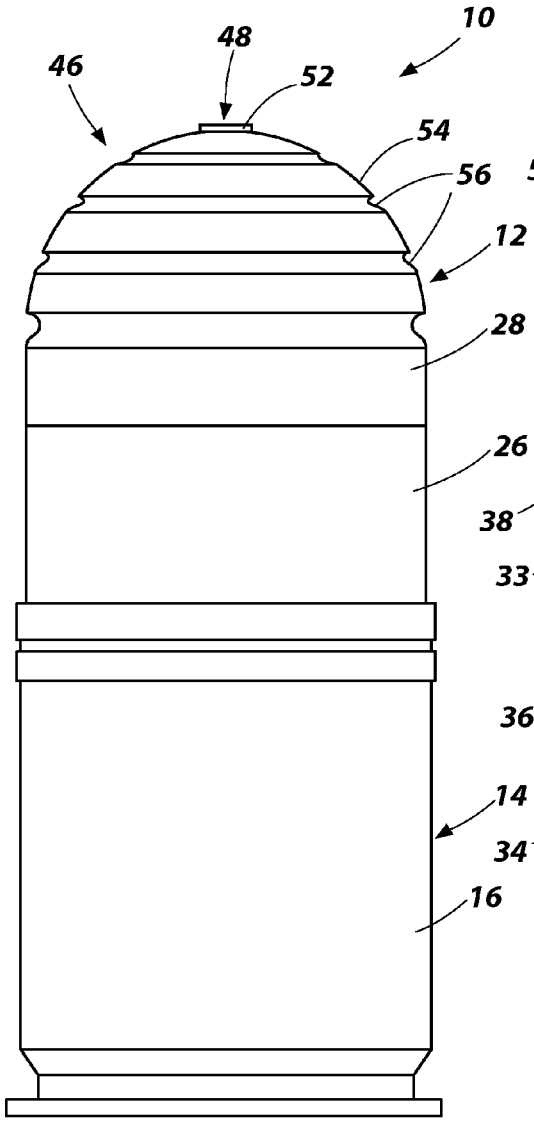
FIG. 1 shows a side view of a cartridge assembly including a projectile, according to an embodiment of the present invention.
Figure 2:
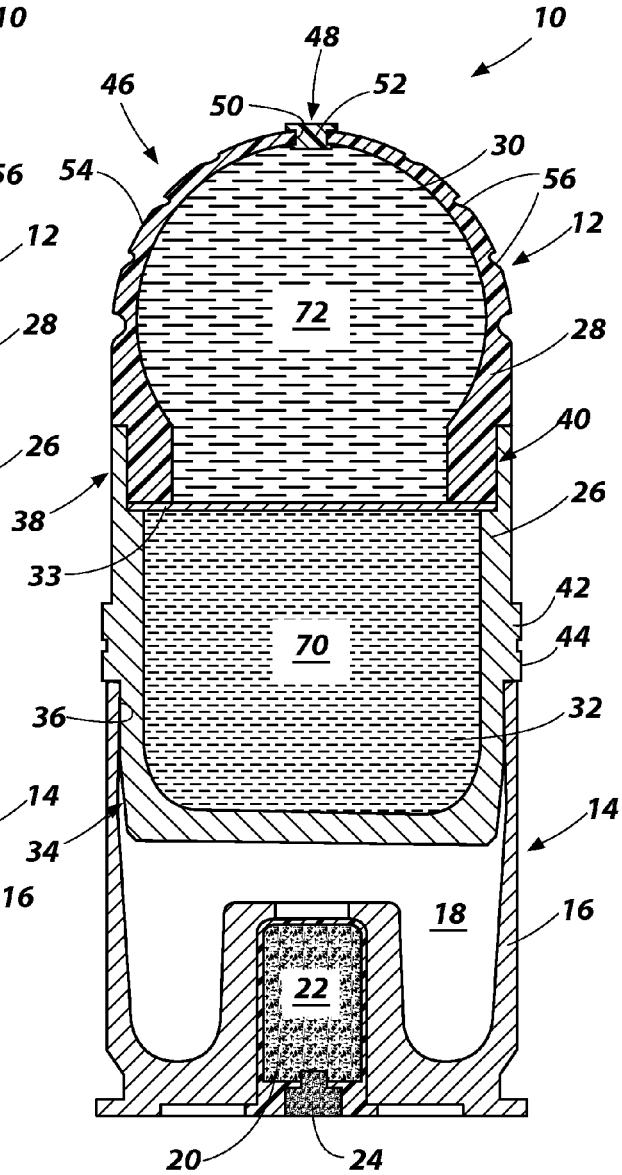
FIG. 2 shows a longitudinal cross-sectional view of the cartridge assembly shown in FIG. 1 taken along the central axis.

As shown in FIGS. 1 and 2, a cartridge assembly 10 for marking the target includes a projectile 12 that may be positioned within a cartridge casing 14, which is configured to propel the projectile 12. For example, the cartridge assembly 10 may be sized and configured as a 40 mm grenade round configured for launching the projectile 12 from a grenade launcher. The cartridge casing 14 may include a generally cup-shaped metallic body 16, such as a brass body, including a pressure chamber 18 and a propellant chamber 20. The propellant chamber 20 may include a powdered propellant 22 therein, such as gunpowder. Additionally, an ignition structure, such as a percussion primer 24, may be located at an end of cartridge casing 14 and extend into the propellant chamber 20.

In one embodiment, the projectile 12 may include a generally cup-shaped base 26, a nose structure 28 and a plurality of compartments, such as a fore compartment 30 and an aft compartment 32 therein, to carry a payload. Additionally, the fore and aft compartments 30 and 32 may be sealed and separated by a septum 33. The base 26 may be formed from a metal, such as brass, or another suitable material. The base 26 may have a trailing end 34 sized and configured to be press fit into an opening 36 of the cartridge casing 14, a leading end 38 sized and configured to correspond and fit with a trailing end 40 of the nose structure 28, and a rotating ring 42 having an enlarged outer diameter positioned between the trailing end 34 and the leading end 38 of the base 26. For example, the enlarged outer diameter 44 of the rotating ring 42 may be sized to interact with a bore of a barrel (not shown) upon launch of the projectile 12 from a launcher. During launch, the outer diameter 44 of the rotating ring 42 may expand, due to the launch forces, and may come into contact with the bore of the barrel. The rotating ring 42 may reduce the amount of expanding gas generated by the propellant 22 that may escape past the projectile 12 within the bore of the barrel and may improve the exit velocity of the projectile 12. Additionally, the rotating ring 42 may interact with riflings formed in the bore of the barrel causing the projectile 12 to spin and may improve the stability and accuracy of the projectile 12. As used herein, the term "stability" means the tendency (i.e., probability) of a projectile to maintain course on one or more of a predictable, intended and repeatable trajectory.

The nose structure 28 may include a leading end 46 and a trailing end 40. The leading end 46 may taper to a pointed or a curved tip 48. For example, the leading end 46 may be generally shaped as an ogive, a cone, a parabola, a hemisphere, a combination thereof, or some other shape. In additional embodiments, the leading end 46 may taper to a relatively small opening 50, which may surround a cap 52 (i.e., a plug). The trailing end 40 may be sized and configured to correspond and fit with the leading end 38 of the base 26. The nose structure 28 may be formed, such as by one or more of injection molding, casting, machining, and shaping. For example, a polymeric nose structure may be formed by injection molding. Additionally, an opening 50 may be formed in tip 48 of the nose structure 28. The nose structure 28 may be formed of a polymeric material, such as a thermoplastic, or a thermoset plastic, or may be formed of another suitable material. An outer surface 54 of the nose structure 28 may include score lines 56 (i.e., grooves) therein that may facilitate a predictable fracturing of the nose structure 28 upon impact with a target. Additionally, the nose structure 28 may define one or more compartments, such as the fore compartment 30, therein configured to carry at least a portion of the payload (i.e., one or more of a fluorophore composition and an activator composition).

In the embodiments described above and illustrated in FIGS. 1, 2 and 7, the nose structure 28 defines a single compartment, such as the fore compartment 30, and the base 26 defines an aft compartment 32. However, in additional embodiments, such as those shown in FIGS. 3-6, a projectile 58 may include a nose structure 60 having a radially segmented cavity 62 that includes at least one internal wall 64 that radially divides the radially segmented cavity 62 into a plurality of radially isolated compartments, such as at least one first radially isolated compartment 66 and at least one second radially isolated compartment 68. Dividing the radially segmented cavity 62 radially may be advantageous for nose structures 60 containing fluorophore and activator compositions 70, 72 that are fluids, as the radially and longitudinally extending internal walls 64 may cause a greater amount of the fluid payload to spin relative to a central axis of the projectile 58 and may increase the angular momentum of the projectile 58 relative to its central axis, improving the stability of the projectile 58.

Figure 3:
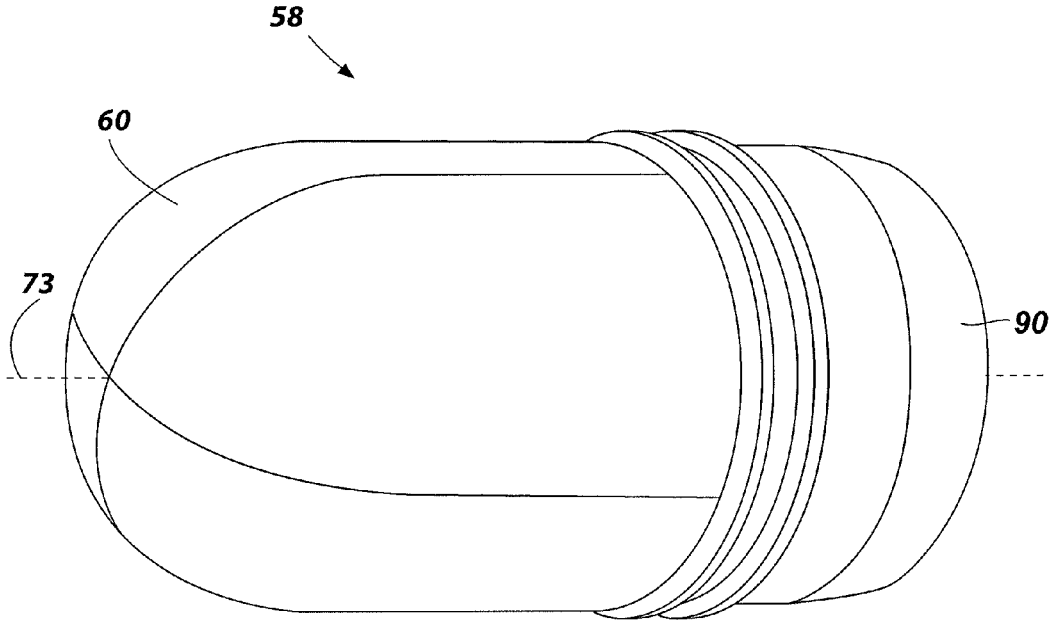
FIG. 3 shows an isometric view of a projectile including a nose structure having a radially segmented cavity defining four radially isolated compartments, according to an embodiment of the present invention.
Figure 4:
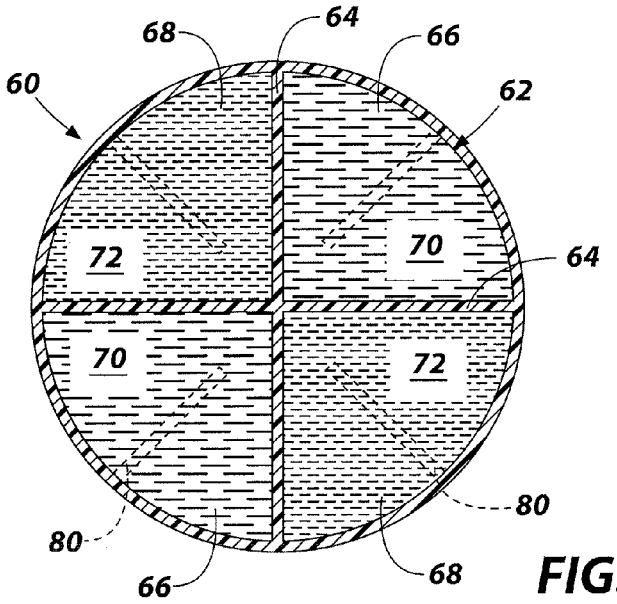
FIG. 4 shows a transverse cross-sectional view of the nose structure of the projectile shown in FIG. 3 taken perpendicular to the central axis.
Figure 5:
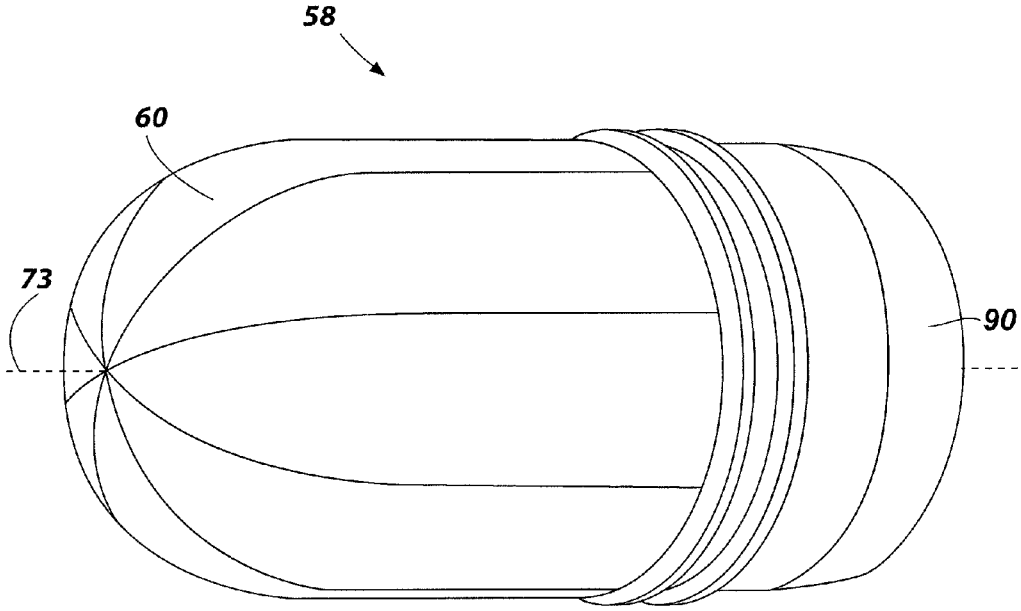
FIG. 5 shows an isometric view of a projectile including a nose structure having a radially segmented cavity defining eight radially isolated compartments, according to an embodiment of the present invention.
Figure 6:
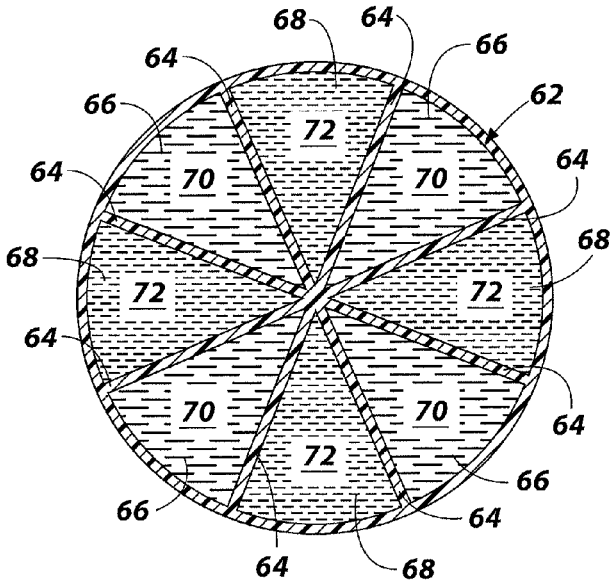
FIG. 6 shows a transverse cross-sectional view of the nose structure of the projectile shown in FIG. 5 taken perpendicular to the central axis.

For embodiments of the projectile 58 that include the radially and longitudinally extending internal walls 64, each radially isolated compartment 66, 68 may share a common internal wall 64 with another radially isolated compartment 66, 68. In view of this, each radially isolated compartment 66, 68 may be contiguous with another radially isolated compartment 66, 68 of the plurality of radially isolated compartments 66, 68 defined within the radially segmented cavity 62. Additionally, each of the radially isolated compartments 66, 68 may have a cross-section generally shaped as a sector of a circle, and the internal walls 64 that extend radially and longitudinally to define the plurality of radially isolated compartments 66, 68 may meet at least proximate to a central axis 73 of the nose structure 60. The central axis 73 of the nose structure 60 may coincide with a central axis of the projectile 58. Such embodiments may include four radially isolated compartments 66, 68, as shown in FIGS. 3 and 4, eight radially isolated compartments 66, 68, as shown in FIGS. 5 and 6, or any other number of radially isolated compartments 66, 68. By increasing the number of radially isolated compartments 66, 68 in the projectile 58, the stability of the projectile 58 may be improved, however, the payload capacity of the projectile 58 may decrease as the number of internal walls 64 increases and utilizes internal space within the projectile 58.

In some embodiments, the nose structure 60 may include internal features to facilitate a predictable fracture of the nose structure 60 upon impact with the target. For example, the nose structure 60 may include a central compartment (not shown) located along the central axis 73 of the nose structure 60 and surrounded by the plurality of radially isolated compartments 66, 68. The central compartment may be tapered, such as in a telescoping arrangement that may facilitate a predictable collapse and/or fracturing of the internal walls 64 of the nose structure 60. Additionally, the internal walls 64 may include additional geometric features, including but not limited to grooves, weakened portions, thinned portions, and angular offsets (i.e., relative the central axis 73 of the nose structure 60), which may facilitate a predictable fracturing of the nose structure 60 upon impact with a target.

The first radially isolated compartments 66 of the plurality of radially isolated compartments 66, 68 may contain a fluorophore composition 70 comprising a fluorophore compound; and at least a second radially isolated compartment 68 of the plurality of radially isolated compartments 66, 68 may contain an activator composition 72 comprising an activator compound. Each of the radially isolated compartments 66, 68 may be sealed, and first radially isolated compartments 66 containing the fluorophore composition 70 may be isolated from second radially isolated compartments 68 containing the activator composition 72. For example, continuous longitudinally extending internal walls 64 may isolate each radially isolated compartment 66, 68, such as previously described herein, and a sealing structure 74 (FIG. 8), such as one or more membranes, a plate, or one or more plugs, may seal an end of each of the radially isolated compartments 66, 68. For example, a sealing structure 74 may be integrally formed with the internal walls 64 or may be sealed to an end of each radially isolated compartment 66, 68 by one or more of an adhesive, a weld, a gasket and an interference fit. Each of the fluorophore and activator compositions 70, 72 may be contained in alternating radially isolated compartments 66, 68, as shown in FIGS. 4 and 6. In view of this, each first radially isolated compartment 66 containing the fluorophore composition 70 may be contiguous with at least one second radially isolated compartment 68 that contains the activator composition 72. For example, each first radially isolated compartment 66 containing the fluorophore composition 70 may be at least partially positioned between and contiguous with two second radially isolated compartments 68 that contain the activator composition 72 and each second radially isolated compartment 68 containing the activator composition 72 may be at least partially positioned between and contiguous with two first radially isolated compartments 66 that contain the fluorophore composition 70.

The nose structure 60 may be formed, such as by one or more of injection molding, casting, and machining, to include the radially segmented cavity 62 defining a plurality of radially isolated compartments 66, 68 within the nose structure 60. A fluorophore composition 70 including the fluorophore compound may be positioned within at least a first radially isolated compartment 66 of the plurality of radially isolated compartments 66, 68 and the activator composition 72 including the activator compound may be positioned within at least a second radially isolated compartment 68 of the plurality of radially isolated compartments 66, 68.

Figure 7:
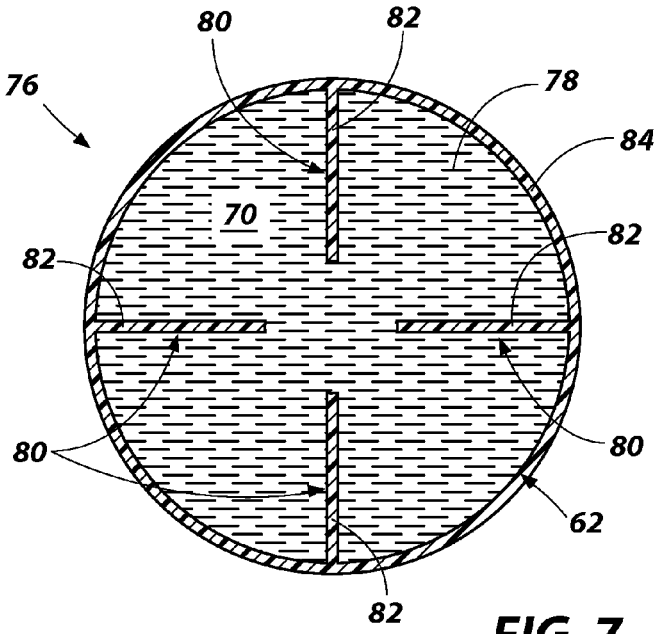
FIG. 7 shows a transverse cross-sectional view taken perpendicular to the central axis of a nose structure having a cavity defining a single compartment, such as shown in FIG. 2, comprising a plurality of radially and longitudinally extending baffles, according to an embodiment of the present invention.

In additional embodiments, such as shown in FIG. 7, a nose structure 76 may include a single, undivided cavity 78 having baffles 80 that may facilitate the imparting of angular momentum to a fluid payload that may be contained therein, such as, for example, the fluorophore composition 70. In other words, the baffles 80 may assist in causing the fluid payload to spin along with the nose structure 76 as the nose structure 76 is spun, such as during launch from a rifled barrel. However, the baffles 80 may occupy a minimal internal volume of the cavity 78. As shown in FIG. 7, the baffles 80 may be comprised of longitudinally and radially extending walls 82, which may be integrally formed with an outer wall 84 of the nose structure 76. In yet additional embodiments, a nose structure may include a radially divided cavity defining a plurality of radially isolated compartments, similar to those shown in FIGS. 3-6. Each of these radially isolated compartments may include one or more radially and longitudinally extending baffles 80 therein, which may assist in causing a fluid payload therein to spin along with the projectile 58. In view of this, the baffles 80 may reduce the tendency of the fluid payload within each cavity 78 to spin relative the cavity 78 and may improve the angular momentum and stability of the projectile 58.

Figure 8:
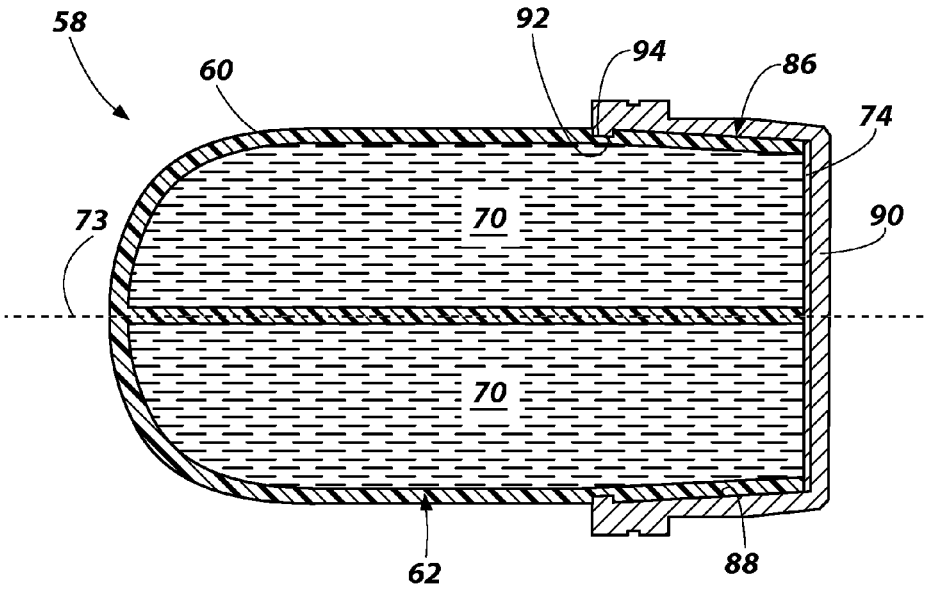
FIG. 8 shows a longitudinal cross-sectional view of a projectile taken along the central axis including a nose structure having a radially segmented cavity defining a plurality of radially isolated compartments, according to an embodiment of the present invention.

The base 26, 90, such as shown in FIGS. 1, 2 and 8, may be formed, such as by one or more of injection molding, casting, machining, and shaping. For example, a base 26, 90 may be formed of a metallic material, such as brass. The fluorophore composition 70 or the activator composition 72 may then be positioned within the aft compartment 32 of the base 26. For example, a fluorophore composition 70 may be injected into the aft compartment 32 of the base 26. A septum 33, such as a metallic disc may then be sealed to the base 26 and seal the aft compartment 32 of the base 26. For example, a relatively thin aluminum disc may be welded to the base 26 and seal the aft compartment 32 of the base 26. The trailing end 40 of the nose structure 28 may then be coupled with the leading end 38 of the base 26 and the trailing end 40 of the nose structure 28 may be sealed with the septum 33. Then the fluorophore composition 70 or the activator composition 72 may be positioned within the fore compartment 30 of the nose structure 28 through an opening 50 in the tip 48 thereof. For example, the activator composition 72 may be injected into the nose structure 28 through the opening 50 in the tip 48 thereof. After filling the nose structure 28, the opening 50 in the tip 48 of the nose structure 28 may be sealed, such as by the insertion of a cap 52. In view of this, the fluorophore composition 70 and the activator composition 72 are separated from one another in the projectile 12 by the septum 33.

In some embodiments, such as shown in FIG. 2, the trailing end 40 of the nose structure 28 may be sized and shaped to correspond to the leading end 38 of the base 26, such that the nose structure 28 does not fill the aft compartment 32 of the base 26. In such embodiments, a septum 33 may be positioned between the aft compartment 32 of the base 26 and the fore compartment 30 of the nose structure 28 and the aft compartment 32 of the base 26 may contain one or more of the fluorophore composition 70 and the activator composition 72. In some embodiments, a thin aluminum disc may be sealed with the base 26 to form the septum 33 between the fore compartment 30 of the nose structure 28 and the aft compartment 32 of the base 26. Additionally, the nose structure 28 may be sealed to the base 26, such as by one or more of an adhesive, a weld, a gasket and an interference fit. For example, an O-ring may be positioned at an interface between the outer walls of the nose structure 28 and the base 26 of the projectile 12. In view of this, one or more compositions within the nose structure 28 may be in contact with the septum 33. The septum 33 may be configured to fracture from forces resulting from the launch of the projectile 12, which may facilitate mixing of the one or more of the fluorophore and activator compositions 70, 72 within the nose structure 28 with one or more fluorophore and activator compositions 70, 72 within the base 26. For example, the septum 33 may include one or more of score lines, grooves, weakened portions, thinned portions and other features that may facilitate a predictable fracturing of the septum 33 upon launch.

In additional embodiments, such as shown in FIG. 8, the trailing end 86 of the nose structure 60 of the projectile 58 (FIG. 5) may be sized and shaped to correspond to a cavity 88 of the base 90 of the projectile 58. The trailing end 86 of the nose structure 60 may be positioned within the cavity 88 of the base 90 of the projectile 58 and may substantially fill the cavity 88 of the base 90. In such embodiments, the entire payload (i.e., the fluorophore and activator compositions 70, 72) may be contained and sealed within the nose structure 60 of the projectile 58. Additionally, corresponding, interlocking features 92, 94 may be formed in the nose structure 60 and in the base 90, which may couple the nose structure 60 to the base 90 of the projectile 58.

Figure 9:
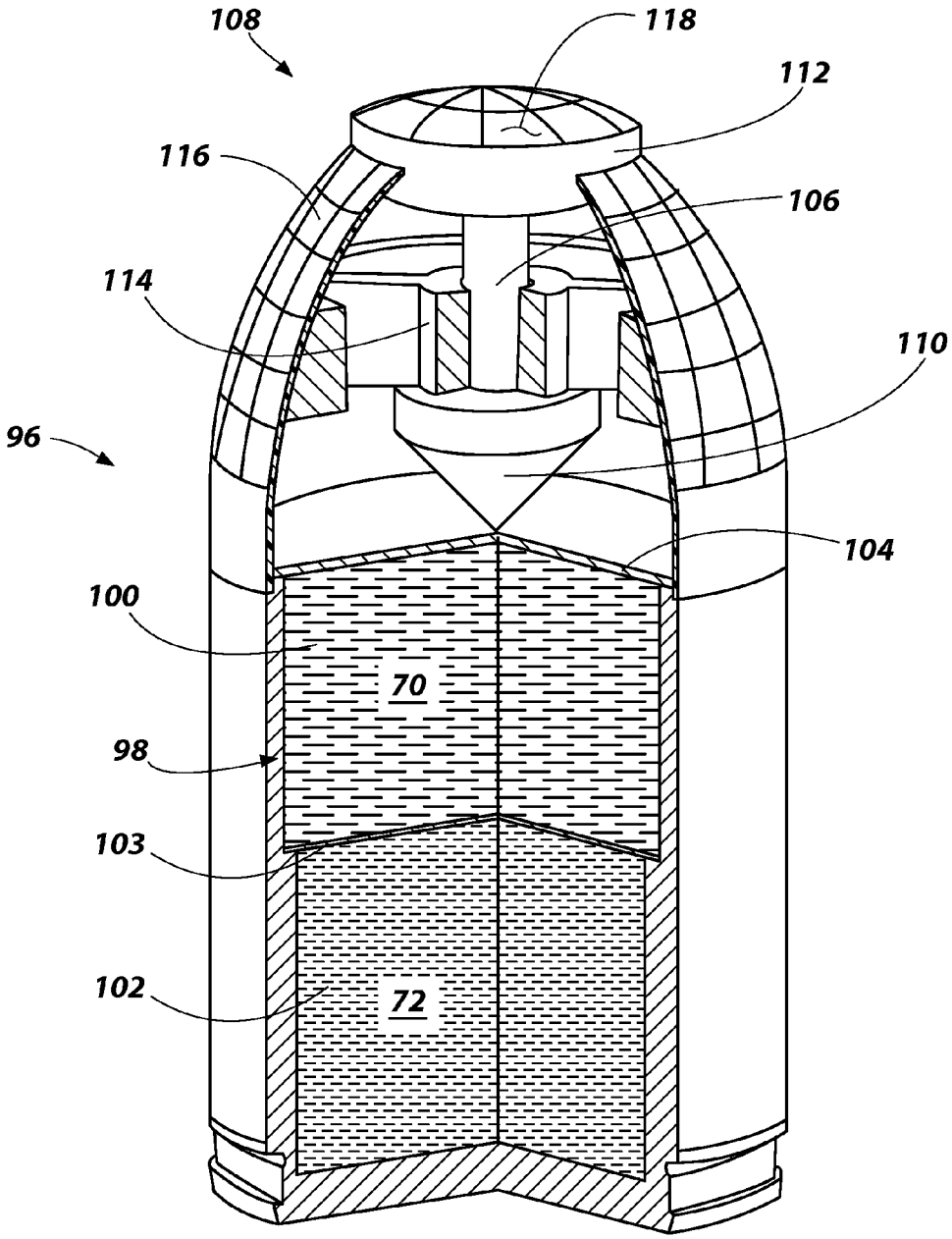
FIG. 9 shows an isometric view of a projectile including a partial cross-sectional view showing an internal pressurized cavity and a plunger device, according to an embodiment of the present invention.

In some embodiments, such as shown in FIG. 9, one or more of the fluorophore and activator compositions 70, 72 contained within the projectile 96 may be pressurized. For example, a pressurized gas may be included within a pressurized cavity 98 of the projectile 96 that may include a plurality of chambers. For example, the fluorophore composition 70 may be contained in a fore chamber 100 and the activator composition 72 may be contained in an aft chamber 102 and the fore and aft chambers 100, 102 may be separated by a septum 103 that may fracture upon launching of the projectile 96. Pressurized gas may be located within a chamber (not shown) that may be separate from either of the fluorophore and activator compositions 70, 72 or may share a chamber 100, 102 with at least one of the fluorophore and activator compositions 70, 72. In some embodiments, the pressurized gas may be an inert gas and may be at least partially dissolved within at least one of the fluorophore and activator compositions 70, 72, similar to a carbonated beverage. In view of this, upon fracturing of the projectile 96, the relative pressure difference between the payload (i.e., the fluorophore and activator compositions 70, 72) within the projectile 96 and the surrounding atmosphere may facilitate a relatively rapid expansion of the fluorophore and activator compositions 70, 72 and propel the fluorophore and activator compositions 70, 72 out of the projectile 96 and onto the target. Additionally, the pressurized gas may facilitate the introduction of gas bubbles into the fluorophore and activator compositions 70, 72, and may result in a foaming of the fluorophore and activator compositions 70, 72, which may facilitate the retention of the fluorophore and activator compositions 70, 72 on an outer surface of the target.

Embodiments that include a pressurized payload may utilize a relatively robust outer wall 104, as shown in FIG. 9. In view of this, the projectile 96 may include a plunger 106 positioned and configured to pierce one or more compartments, such as a pressurized fore chamber 100. As shown in FIG. 9, the plunger 106 may be located at the leading end 108 of the projectile 96 and may include a piercing head 110 at one end and an impact head 112 at the other end that may form a leading tip of the projectile 96. A guide structure 114 may be positioned within an exterior shell 116 and the plunger 106 may extend through the guide structure 114. Additionally, the impact head 112 of the plunger 106 may be coupled to the exterior shell 116, such that the exterior shell 116 may support the plunger 106 and prevent any significant movement of the plunger 106 that may otherwise result from inertial forces upon launch of the projectile 96. The exterior shell 116 may also include one or more of radially extending score lines (e.g., grooves) and longitudinally extending score lines in a surface thereof to facilitate fracturing of the exterior shell 116 upon impact with a target. Optionally, a leading surface 118 of the impact head 112 may be relatively rough; for example, the leading surface 118 may be knurled, which may improve the friction between the leading surface 118 and a target and may prevent the deflection of the projectile 96 from the target.

In use and operation, the projectile 12, 58, 96, configured as one of the embodiments described above, is used to mark a target with a luminescent composition by impacting the target with the projectile 12, 58, 96. The luminescent composition is produced by the reaction of the fluorophore compound of the fluorophore composition 70 with the activator compound of the activator composition 72. In one embodiment, the fluorophore and activator compositions 70, 72 come into contact with one another upon launch of the projectile 12, 58, 96, enabling their reaction during the flight of the projectile 12, 58, 96. For instance, the launch forces may fragment or rupture the septum 33 or the radially and longitudinally extending internal walls 64, enabling the fluorophore and activator compositions 70, 72 to combine with one another. In another embodiment, the fluorophore and activator compositions 70, 72 come into contact with one another upon impact of the projectile 12, 58, 96 with the target. When the projectile 12, 58, 96 impacts the target and fractures, the fluorophore and activator compositions 70, 72 may combine with one another. Contact between the fluorophore compound and the activator compound of the fluorophore and activator compositions 70, 72 causes the fluorophore compound and the activator compound to react and luminesce, producing light in the visible or NIR spectrum. Specifically, the oxalate compound of the fluorophore composition 70 is oxidized by the activator compound of the activator composition 72 to produce a four-membered peroxyacid compound. The peroxyacid compound is unstable and produces carbon dioxide and energy, which excites the fluorophore compound and causes the release of a photon as the fluorophore compound relaxes to its ground state. The wavelength of light produced by the luminescent compound depends on the fluorophore compound used. As the projectile 12, 58, 96 impacts the target, the projectile 12, 58, 96 may fracture, discharging the luminescent composition from the projectile 12, 58, 96 and onto the target. The luminescent composition may thus be dispersed on the target. The projectile 12, 58, 96 may be launched from a standoff distance of up to about 300 meters from the target, such as from about 150 meters to about 250 meters.

The luminescent composition may be of sufficient intensity and output to be detectable on the target for a desired amount of time, such as on the order of from about 5 minutes to about 10 minutes. The luminescent composition may be visible at a distance of about 1 mile. If the fluorophore compound emits light in the visible spectrum, the marked target may be visible to the human eye. If, however, the fluorophore compound emits light in the NIR spectrum, the marked target may be substantially invisible to the human eye. However, the marked target may be detectable with an instrument capable of detecting NIR light, such as an infrared detection device or night vision device. By using such a fluorophore compound, the projectile may be used in covert operations because the marked target is only detectable to those having NIR vision equipment. If the projectile includes at least one pressurized cavity 98, the plunger 106 may pierce the at least one pressurized cavity 98 and a pressurized gas within the at least one pressurized cavity 98 may foam the luminescent compound and expel at least a portion of the luminescent compound from the pressurized cavity 98 and onto the target.

The fluorophore composition may include at least one fluorophore compound, at least one oxalate compound, and at least one solvent. These components of the fluorophore composition are commercially available, such as, for example, from Sigma-Aldrich Co. (St. Louis, Mo.) or other chemical suppliers. Depending on the fluorophore compound used, the luminescent composition may emit light within the visible spectrum, such as light that appears green, blue, yellow-green, yellow, orange, or red to the human eye, or in the NIR spectrum. Examples of fluorophore compounds that, when activated, emit light in the visible spectrum include, but are not limited to, 1,8-dichloro-9,10-bis(phenyl-ethynyl)anthracene (green), 9,10-diphenylanthracene (blue), tetracene (yellow-green), 1-chloro-9,10-bis(phenylethynyl)anthracene (yellow), 5,12-bis(phenylethynyl)naphthacene (orange), rubrene (orange), rhodamine 6G (orange), and rhodamine B (red). The color of light emitted by the fluorophore compound is shown in parentheses. The fluorophore compound may be selected based on the desired color of light to be emitted by the luminescent composition. For example, 1,8-dichloro-9,10-bis(phenyl-ethynyl)anthracene may be used as the fluorophore compound if the luminescent composition is to emit green light. The fluorophore compound may account for about 1% by weight (wt %) or less of the total weight of the fluorophore composition, such as from about 0.05 wt % to about 1 wt % of the total weight of the fluorophore composition. For example, the fluorophore compound may account for from about 0.1 wt % to about 0.4 wt % of the total weight of the fluorophore composition, such as from about 0.25 wt % to about 0.35 wt % of the total weight of the fluorophore composition. In one embodiment, 1,8-dichloro-9,10-bis(phenyl-ethynyl)anthracene is present in the fluorophore composition at 0.3 wt %. The ratio of fluorophore compound to solvent (fluorophore compound:solvent) may be from about 10:90 to about 30:70.

If the luminescent composition is to emit light in the visible light spectrum, the oxalate compound used in the fluorophore composition may include at least one of bis(2,4,5-trichloro-6-carbopentoxyphenyl)oxalate (CPPO), bis(2-carbopentyloxy-3,5,6,-trichlorophenyl)oxalate (CTCPO), bis(2,4,6-trichlorophenyl)oxalate (TCPO), [bis-(2-(3,6,9-trioadecanyloxycarbonyl)-4-nitrophenyl]oxalate (TDPO), and bis(2,4-dinitrophenyl)oxalate (DNPO). The oxalate compound may account for from about 5 wt % to about 20 wt % of the total weight of the fluorophore composition, such as from about 12 wt % to about 17 wt % of the total weight of the fluorophore composition. In one embodiment, the fluorophore composition includes about 15 wt % CPPO.

If the luminescent composition is to emit light in the visible light spectrum, the solvent may be at least one phthalate compound, such as dibutyl phthalate (DBP), dimethyl phthalate (DMP), diethyl phthalate (DEP), or combinations thereof. The solvent may make up the remainder of the fluorophore composition. As such, the solvent may account for from about 70 wt % to about 90 wt % of the total weight of the fluorophore composition. In one embodiment, the solvent includes a mixture of DBP and DMP. The weight ratio of DBP to DMP (DBP:DMP) may be from about 95:5 to about 50:50, such as from about 90:10 to about 75:25. In one embodiment, the weight ratio of DBP to DMP is 80:20.

If the luminescent composition is to emit light in the visible light spectrum, the activator composition may include at least one activator compound, at least one thickening agent, a sodium phosphate, at least one solvent, and, optionally, a luminescent catalyst system. These components of the activator composition are commercially available, such as, for example, from Sigma-Aldrich Co. (St. Louis, Mo.) or other chemical suppliers. The activator compound may include, but is not limited to, hydrogen peroxide. The hydrogen peroxide may be used as a 35% solution (v:v) in water. The activator compound may be present in a range of from about 1 wt % to about 10 wt % of the total weight of the activator composition. For example, the activator compound may be present at from about 2 wt % to about 7 wt % of the total weight of the activator composition, such as from about 3 wt % to about 5 wt % of the total weight of the activator composition. In one embodiment, the activator composition includes 4 wt % hydrogen peroxide.

The thickening agent may be polyethylene glycol (PEG), such as PEG having a molecular weight of about 600 grams per mole (PEG 600). However, PEG having a higher or lower molecular weight may also be used. The thickening agent may be present in the activator composition at from about 2 wt % to about 25 wt % of the total weight of the activator composition. For example, the activator composition may include PEG in the range of about 12 wt % to about 18 wt % of the total weight of the activator composition, such as from about 15 wt % to about 17 wt % of the total weight of the activator composition. In one embodiment, the activator composition includes about 16 wt % PEG 600.

The sodium phosphate, such as tribasic sodium phosphate, may be present in the activator composition as a buffer. The sodium phosphate may account for from about 0.005 wt % to about 1 wt % of the total weight of the activator composition. For example, the sodium phosphate may be present at from 0.1 wt % to about 0.5 wt % of the total weight of the activator composition, such as from about 0.15 wt % to about 0.25 wt % of the total weight of the activator composition. In one embodiment, the activator composition includes about $1\times10^{-4}$ M tribasic sodium phosphate.

The luminescent catalyst system, if present, may include a mixture of surfactants and at least one solvent, such as an alcohol, polypropylene glycol, or water. The mixture of surfactants may include at least one anionic surfactant, at least one nonionic surfactant, or combinations thereof. The above components may be combined, forming the luminescent catalyst system, which is added to the activator composition. The luminescent catalyst system may be present in the activator composition at from approximately 0.005 wt % to approximately 2.00 wt %, such as from approximately 0.0075 wt % to approximately 0.2 wt %, or from approximately 0.01 wt % to approximately 0.015 wt %. The luminescent catalyst system, if present, may increase the viscosity of the fluorophore composition, which mitigates spinning of the fluorophore composition during the flight of the projectile.

The luminescent catalyst system may include an alkyl anionic sulfate surfactant (sodium salt), an alkyl ethoxylated anionic sulfate surfactant (sodium salt), an alkyl dimethyl amine oxide, an ethoxylated condensate of an alkyl alcohol, sodium cumene sulfate, ethyl alcohol, polypropylene glycol ($(HO—C_3H_6O)_n—H$) where n is from 20 to 30), and water. The alkyl portion of the alkyl anionic sulfate surfactant may include from ten carbon atoms to sixteen carbon atoms ($C_{10}$ to $C_{16}$). The alkyl anionic sulfate surfactant may include, but is not limited to, a linear allylbenzene sulfonate, alpha olefin sulfonate, paraffin sulfonate, methyl ester sulfonate, alkyl sulfate, alkyl alkoxy sulfate, alkyl sulfonate, alkyl alkoxylated sulfate, sarcosinate, alkyl alkoxy carboxylate, taurinate, or combinations thereof. By way of non-limiting example, the alkyl anionic sulfate surfactant may be sodium dodecyl benzene sulfonate. The alkyl anionic sulfate surfactant may account for from approximately 10 wt % to approximately 30 wt % of the luminescent catalyst system, such as from approximately 20 wt % to approximately 30 wt % of the luminescent catalyst system.

The alkyl portion of the alkyl ethoxylated anionic sulfate surfactant may include from ten carbon atoms to sixteen carbon atoms ($C_{10}$ to $C_{16}$), and the ethoxylated portion of the alkyl ethoxylated anionic sulfate surfactant may be $(C_2H_4O)_n$, where n is from 5 to 30. By way of non-limiting example, the alkyl ethoxylated anionic sulfate surfactant may be ethoxylated (n=9) sodium dodecyl sulfate. The alkyl ethoxylated anionic sulfate surfactant may account for from approximately 10 wt % to approximately 30 wt % of the luminescent catalyst system, such as from approximately 15 wt % to approximately 25 wt % of the luminescent catalyst system. The alkyl portion of the alkyl dimethyl amine oxide may include from ten carbon atoms to sixteen carbon atoms ($C_{10}$ to $C_{16}$). The alkyl dimethyl amine oxide may include, but is not limited to, 1,3 propane diamine, 1,6 hexane diamine, 1,3 pentane diamine, 2-methyl 1,5 pentane diamine, hexamethylene diamine, dodecyl dimethyl amine oxide, or a primary diamine with an alkylene spacer ranging from $C_4$ to $C_8$. By way of non-limiting example, the alkyl dimethyl amine oxide may be dodecyl dimethyl amine oxide. The alkyl dimethyl amine oxide may account for from approximately 1 wt % to approximately 10 wt % of the luminescent catalyst system, such as from approximately 3 wt % to approximately 6 wt % of the luminescent catalyst system.

The ethoxylated portion of the ethoxylated condensate of the alkyl alcohol may be $(C_2H_4O)_n$, where n is from 5 to 30, and the alkyl portion of the ethoxylated condensate of the alkyl alcohol may include from ten carbon atoms to fourteen carbon atoms ($C_{10}$ to $C_{14}$). By way of non-limiting example, the ethoxylated condensate of the alkyl alcohol may be ethoxylated (n=9) undecyl alcohol. The ethoxylated condensate of the alkyl alcohol may account for from approximately 2 wt % to approximately 6 wt % of the luminescent catalyst system, such as from approximately 3 wt % to approximately 5 wt % of the luminescent catalyst system. Sodium cumene sulfate may account for from approximately 1 wt % to approximately 6 wt % of the luminescent catalyst system, such as from approximately 2 wt % to approximately 4 wt % of the luminescent catalyst system. Ethyl alcohol may account for from 3 wt % to 10 wt % of the luminescent catalyst system, such as from approximately 5 wt % to approximately 8 wt % of the luminescent catalyst system. Polypropylene glycol may account for from approximately 1 wt % to approximately 8 wt % of the luminescent catalyst system, such as from approximately 3 wt % to approximately 5 wt % of the luminescent catalyst system. Water may account for the remainder of the luminescent catalyst system, such as from approximately 20 wt % to approximately 80 wt % of the luminescent catalyst system or from approximately 40 wt % to approximately 70 wt % of the luminescent catalyst system.

In one embodiment, the luminescent catalyst system includes 25 wt % sodium dodecyl benzene sulfonate, 18 wt % ethoxylated (n=9) sodium dodecyl sulfate, 5 wt % dodecyl dimethyl amine oxide, 4 wt % ethoxylated (n=9) undecyl alcohol, from approximately 2 wt % to approximately 4 wt % sodium cumene sulfate, from approximately 5 wt % to approximately 8 wt % ethyl alcohol, from approximately 3 wt % to approximately 5 wt % polypropylene glycol, and the balance water.

The solvent used in the activator composition may include at least one of the above-mentioned phthalate compounds, such as DBP, DMP, DEP, or combinations thereof. In addition, the solvent of the activator composition may include t-butanol and water. The solvent may make up the balance of the activator composition. As such, the solvent may account for from about 45 wt % to about 97 wt % of the total weight of the activator composition. In one embodiment, the solvent includes a combination of DEP, DMP, t-butanol, and water. The weight ratio of DEP to DMP (DEP:DMP) may be from about 10:90 to about 90:10, such as from about 30:70 to about 70:30. The DEP and the DMP may account for from about 45 wt % to about 65 wt % of the total weight of the activator composition. The t-butanol may be present in a range of about 5 wt % to about 30 wt % of the total weight of the activator composition, such as from about 12 wt % to about 18 wt % of the total weight of the activator composition. The weight ratio of t-butanol to phthalate compound (t-butanol:phthalate compound) may be from about 5:95 to about 30:70. The remainder of the solvent may be water. In one embodiment, the solvent includes 18 wt % DEP, 38 wt % DMP, 15 wt % t-butanol, and 9 wt % water.

In one embodiment of a luminescent composition that produces light in the visible light spectrum, the fluorophore composition includes 0.3 wt % 1,8-dichloro-9,10-bis(phenylethynyl)anthracene, 15 wt % CPPO, and 85 wt % of a solvent mixture that includes DBP and DMP at a weight ratio of 80:20 (DBP:DMP), and the activator composition includes 4 wt % hydrogen peroxide, $1\times10^{-4}$ M tribasic sodium phosphate, from approximately 0.01 wt % to approximately 0.015 wt % of the luminescent catalyst system, and 16 wt % PEG 600, with the balance being a solvent mixture that includes 18 wt % DEP, 38 wt % DMP, 15 wt % t-butanol, and 9 wt % water. The luminescent catalyst system includes 25 wt % sodium dodecyl benzene sulfonate, 18 wt % ethoxylated (n=9) sodium dodecyl sulfate, 5 wt % dodecyl dimethyl amine oxide, 4 wt % ethoxylated (n=9) undecyl alcohol, from approximately 2 wt % to approximately 4 wt % sodium cumene sulfate, from approximately 5 wt % to approximately 8 wt % ethyl alcohol, from approximately 3 wt % to approximately 5 wt % polypropylene glycol, and the balance water.

If the luminescent composition is to emit light in the NIR spectrum, the fluorophore composition may include at least one fluorophore compound that emits light in the NIR spectrum. An example of a fluorophore compound that, when activated, emits light in the visible spectrum includes, but is not limited to, 1,4,8,11,15,18,22,25-octabutoxy-29H,31H-phthalocyanine. The fluorophore compound may account for about 0.5 wt % or less of the total weight of the fluorophore composition, such as from about 0.005 wt % to about 0.5 wt % of the total weight of the fluorophore composition. For example, the fluorophore compound may account for from about 0.05 wt % to about 0.3 wt % of the total weight of the fluorophore composition, such as from about 0.1 wt % to about 0.2 wt % of the total weight of the fluorophore composition.

If the luminescent composition is to emit light in the NIR spectrum, the fluorophore composition also includes the at least one oxalate compound and the at least one solvent. Oxalate compounds and solvents that may be used are as described above. In one embodiment, the oxalate compound is CTCPO. The oxalate compound may account for from about 2 wt % to about 10 wt % of the total weight of the fluorophore composition, such as from about 4 wt % to about 7 wt % of the total weight of the fluorophore composition. The solvent may make up the balance of the fluorophore composition. As such, the solvent may account for from about 90 wt % to about 98 wt % of the total weight of the fluorophore composition. In one embodiment, the solvent includes a mixture of DBP and DMP. The weight ratio of DBP to DMP (DBP:DMP) may be from about 95:5 to about 50:50, such as from about 80:20 to about 60:40.

If the luminescent composition is to emit light in the NIR spectrum, the activator composition may include the at least one activator compound, the at least one thickening agent, the sodium phosphate, the at least one solvent, and, optionally, the luminescent catalyst system. Examples of activator compounds, thickening agents, sodium phosphates, luminescent catalyst systems, and solvents are as described above. The activator compound may be present in a range of from about 5 wt % to about 30 wt % of the total weight of the activator composition. For example, the activator compound may be present from about 10 wt % to about 20 wt % of the total weight of the activator composition, such as from about 12 wt % to about 15 wt % of the total weight of the activator composition. In one embodiment, the activator composition includes 12.3 wt % hydrogen peroxide.

The thickening agent may be present in the activator composition at from about 2 wt % to about 20 wt % of the total weight of the activator composition. For example, the activator composition may include PEG in the range of from about 8 wt % to about 15 wt % of the total weight of the activator composition, such as from about 11 wt % to about 13 wt % of the total weight of the activator composition. In one embodiment, the activator composition includes about 16.43 wt % PEG 600. The sodium phosphate may account for from about 0.005 wt % to about 1 wt % of the total weight of the activator composition. For example, the sodium phosphate may be present at from about 0.1 wt % to about 0.5 wt % of the total weight of the activator composition, such as from about 0.15 wt % to about 0.25 wt % of the total weight of the activator composition. In one embodiment, the activator composition includes about 0.21 wt % tribasic sodium phosphate.

The solvent in the activator composition may include at least one of the above-mentioned phthalate compounds, such as DBP, DMP, DEP, or combinations thereof. In addition, the solvent may include t-butanol and water. The solvent may make up the balance of the activator composition. As such, the solvent may account for from about 49 wt % to about 93 wt % of the total weight of the activator composition. In one embodiment, the solvent includes a mixture of DEP, DMP, t-butanol, and water. The weight ratio of DEP to DMP (DEP:DMP) may be from about 10:90 to about 90:10, such as from about 30:70 to about 70:30. The DEP and the DMP may account for from about 45 wt % to about 65 wt % of the total weight of the activator composition. The t-butanol may be present in a range of about 5 wt % to about 30 wt % of the total weight of the activator composition, such as from about 12 wt % to about 18 wt % of the total weight of the activator composition. The weight ratio of t-butanol to phthalate compound (t-butanol:phthalate compound) may be from about 5:95 to about 30:70. The remainder of the solvent may be water. In one embodiment, the solvent includes 18.62 wt % DEP, 37.45 wt % DMP, and 14.99 wt % t-butanol.

In one embodiment of a luminescent composition that produces light in the NIR spectrum, the fluorophore composition includes 0.15 wt % 1,4,8,11,15,18,22,25-octabutoxy-29H,31H-phthalocyanine, 5.39 wt % CTCPO, 70.47 wt % DBP, and 23.99 wt % DMP, and the activator composition includes 12.3 wt % hydrogen peroxide (35% solution), 0.21 wt % tribasic sodium phosphate, 16.43 wt % PEG 600, 18.62 wt % DEP, 37.45 wt % DMP, 14.99 wt % t-butanol, and from approximately 0.01 wt % to approximately 0.015 wt % of the luminescent catalyst system. The luminescent catalyst system includes 25 wt % sodium dodecyl benzene sulfonate, 18 wt % ethoxylated (n=9) sodium dodecyl sulfate, 5 wt % dodecyl dimethyl amine oxide, 4 wt % ethoxylated (n=9) undecyl alcohol, from approximately 2 wt % to approximately 4 wt % sodium cumene sulfate, from approximately 5 wt % to approximately 8 wt % ethyl alcohol, from approximately 3 wt % to approximately 5 wt % polypropylene glycol, and the balance water. In another embodiment, the fluorophore composition includes 0.15 wt % 1,4,8,11,15,18,22,25-octabutoxy-29H,31H-phthalocyanine, 5.39 wt % CTCPO, 71.83 wt % DBP, and 24.45 wt % DMP, and the activator composition includes 12.3 wt % hydrogen peroxide (35% solution), 0.21 wt % tribasic sodium phosphate, 16.43 wt % PEG 600, 18.62 wt % DEP, 37.45 wt % DMP, 14.99 wt % t-butanol, and from approximately 0.01 wt % to approximately 0.015 wt % of the luminescent catalyst system. The luminescent catalyst system includes 25 wt % sodium dodecyl benzene sulfonate, 18 wt % ethoxylated (n=9) sodium dodecyl sulfate, 5 wt % dodecyl dimethyl amine oxide, 4 wt % ethoxylated (n=9) undecyl alcohol, from approximately 2 wt % to approximately 4 wt % sodium cumene sulfate, from approximately 5 wt % to approximately 8 wt % ethyl alcohol, from approximately 3 wt % to approximately 5 wt % polypropylene glycol, and the balance water.

By appropriately selecting the relative amounts of the components of the fluorophore and activator compositions, the components of the fluorophore and activator compositions may be substantially soluble in the solvent used. For instance, the fluorophore compound and the activator compound may be substantially soluble in their respective compositions. As such, the fluorophore and the activator compositions may be substantially homogeneous. In addition, the fluorophore and the activator compositions may form a single phase. The components of the fluorophore and activator compositions may also be substantially soluble in the luminescent composition, produced when the fluorophore and activator compositions are combined, which results in increased light output of the luminescent composition. The components of the fluorophore and activator compositions may also be compatible with the materials used to form the projectile.

Each of the fluorophore composition and the activator composition may be produced by combining the respective components with mixing. The fluorophore composition and the activator composition may then be loaded into the projectile by injection, pouring, or other conventional technique.

Although this invention has been described with reference to particular embodiments, the invention is not limited to these described embodiments. Rather, the invention is limited only by the appended claims and their legal equivalents.

What is claimed is:

1. A projectile, comprising:

a nose structure comprising a cavity radially segmented into a plurality of isolated compartments by at least one laterally and radially extending internal wall;

at least one radially and longitudinally extending baffle in at least one isolated compartment of the plurality of isolated compartments;

a fluorophore composition comprising a fluorophore compound contained in at least one isolated compartment of the plurality of isolated compartments; and an activator composition comprising an activator compound contained in at least another isolated compartment of the plurality of isolated compartments.

2. The projectile of claim 1, wherein each isolated compartment of the plurality of isolated compartments containing the fluorophore composition is radially contiguous with at least one isolated compartment of the plurality of isolated compartments containing the activator composition.

3. The projectile of claim 1, wherein the fluorophore compound and the activator compound are formulated, upon combination, to react to emit light within the visible light spectrum.

4. The projectile of claim 1, wherein the fluorophore compound and the activator compound are formulated, upon combination, to react to emit light within the near infrared light spectrum.

5. The projectile of claim 1, wherein the fluorophore composition comprises 1,4,8,11,15,18,22,25-octabutoxy-29H, 31H-phthalocyanine, an oxalate compound and at least one phthalate compound.

6. The projectile of claim 5, wherein the activator composition comprises hydrogen peroxide, a sodium phosphate, polyethylene glycol, water, tert-butanol, a luminescent catalyst system, and at least one phthalate compound.

7. The projectile of claim 1, wherein the fluorophore composition comprises 1,8-dichloro-9,10-bis(phenyl-ethynypanthracene, bis(2,4,5-trichloro-6-carbopentoxyphenyl)oxalate, and at least one phthalate compound.

8. The projectile of claim 7, wherein the activator composition comprises hydrogen peroxide, a sodium phosphate, polyethylene glycol, water, tert-butanol, a luminescent catalyst system, and at least one phthalate compound.

9. The projectile of claim 1, wherein the projectile is sized and configured as a 40 mm diameter ordnance round.

10. The projectile of claim 1, wherein each of the fluorophore composition and activator composition is substantially free of energetic materials.

11. The projectile of claim 1, wherein each of the fluorophore composition and activator composition is a fluid.

12. A method of manufacturing a projectile, the method comprising:

forming a nose structure comprising a plurality of radially isolated compartments within the nose structure;

forming at least one radially and longitudinally extending baffle within at least one radially isolated compartment of the plurality of radially isolated compartments;

positioning a fluorophore composition comprising a fluorophore compound within at least a first radially isolated compartment of the plurality of radially isolated compartments; and positioning an activator composition comprising an activator compound within at least a second radially isolated compartment of the plurality of radially isolated compartments.

13. A method of marking a target, the method comprising:

launching a projectile comprising a plurality of radially isolated compartments, at least one of the plurality of radially isolated compartments containing a fluorophore composition, at least one of the plurality of radially isolated compartments containing an activator composition, and at least one of the plurality of radially isolated compartments comprising at least one radially and longitudinally extending baffle within at least one radially isolated compartment of the plurality of radially isolated compartments;

combining the fluorophore composition and the activator composition to form a luminescent composition; and impacting a target with the projectile to disperse the luminescent composition onto the target.

14. The method of claim 13, wherein combining the fluorophore composition and the activator composition to form a luminescent composition comprises combining the fluorophore composition and the activator composition during flight of the projectile.

15. The method of claim 13, wherein combining the fluorophore composition and the activator composition to form a luminescent composition comprises combining the fluorophore composition and the activator composition upon impact of the projectile with the target.

16. A method of marking a target, the method comprising:

launching a projectile comprising a plurality of radially isolated compartments, at least one of the plurality of radially isolated compartments containing a fluorophore composition and at least one of the plurality of radially isolated compartments containing an activator composition;

imparting angular momentum from at least one radially and longitudinally extending baffle within at least one radially isolated compartment of the plurality of radially isolated compartments to at least one of the fluorophore composition and the activator composition;

combining the fluorophore composition and the activator composition to form a luminescent composition upon impact of the projectile with a target; and dispersing the luminescent composition onto the target.

17. The method of claim 16, wherein imparting angular momentum from at least one radially and longitudinally extending baffle within at least one radially isolated compartment of the plurality of radially isolated compartments to at least one of the fluorophore composition and the activator composition comprises causing at least one of the fluorophore composition and the activator composition to spin along with the projectile.

* * * * *

UNITED STATES PATENT AND TRADEMARK OFFICE

CERTIFICATE OF CORRECTION

PATENT NO. : 8,286,557 B2
APPLICATION NO. : 12/534450
DATED : October 16, 2012
INVENTOR(S) : David W. Endicott, Jr. et al.

It is certified that error appears in the above-identified patent and that said Letters Patent is hereby corrected as shown below:

On the title page:

In ITEM (75) Inventors: Change "David W. Endicott," to --David W. Endicott JR,--

In the claims:

CLAIM 7, COLUMN 15, LINES 46, 47: Change "10-bis(phenyl-ethynypanthracene," to --10-bis(phenyl-ethynyl)anthracene,--

Signed and Sealed this
Nineteenth Day of February, 2013

Teresa Stanek Rea
*Acting Director of the United States Patent and Trademark Office*